US006482098B1

(12) United States Patent
Yates

(10) Patent No.: US 6,482,098 B1
(45) Date of Patent: Nov. 19, 2002

(54) GOLF BALL TARGET DEVICE

(76) Inventor: Patrick D. Yates, 21417 Brewer Rd., Grass Valley, CA (US) 95949

( * ) Notice: Subject to any disclaimer, the term of this patent is extended or adjusted under 35 U.S.C. 154(b) by 0 days.

(21) Appl. No.: 09/660,086

(22) Filed: Sep. 12, 2000

(51) Int. Cl.[7] ..... A63B 69/36
(52) U.S. Cl. ..... 473/185; 473/180
(58) Field of Search ..... 473/159, 172, 473/173, 174, 180, 181, 185, 195, 182, 183, 184

(56) References Cited

U.S. PATENT DOCUMENTS 884,277 A * 4/1908 Hughes ..... 473/180
1,693,474 A * 11/1928 Burt ..... 473/185
3,114,556 A * 12/1963 Miller ..... 473/185
3,134,597 A * 5/1964 Brandell ..... 473/183
3,659,856 A * 5/1972 Fatur ..... 473/180
3,801,107 A * 4/1974 Martin ..... 473/185
3,862,760 A * 1/1975 Davis ..... 473/181
3,876,210 A * 4/1975 Brandell ..... 473/181
5,407,203 A * 4/1995 Jones ..... 473/185
5,645,492 A * 7/1997 Anderson ..... 473/185
5,692,963 A * 12/1997 Holcombe ..... 473/185

* cited by examiner

*Primary Examiner*—Mark S. Graham
(74) *Attorney, Agent, or Firm*—Thomas R. Lampe

(57) ABSTRACT

A golf ball target device of unitary construction includes a hub portion and a plurality of arms radiating outwardly from the hub portion. The hub portion and arms form a number of target pockets. At least one projection projects into each target pocket to impede movement of a golf ball within the target pocket.

8 Claims, 2 Drawing Sheets

GOLF BALL TARGET DEVICE

TECHNICAL FIELD

This invention relates to a target device for use by a golfer when practicing his or her putting. The target device can also be employed as a game component.

BACKGROUND OF THE INVENTION

Portable target devices for golf balls are well known. Such devices can range from the simple approach of tipping a glass on the floor and using the open end of the glass as a target to far more elaborate devices which define a target opening simulating a golf course hole and which incorporate a mechanism which will automatically eject a golf ball therefrom after a successful shot has been made.

Prior art golf ball target devices of the latter type conventionally require that a golf ball roll up an uphill slope of the device leading to the hole. This arrangement does not provide a true duplication or simulation of a golf course hole which has an entrance or opening on the same generally planar surface on which one normally putts. That is, a player must adjust his or her stroke to apply more power to the ball to move it up the uphill slope than is the case where the target hole is level with the surrounding putting surface. Furthermore, some golf ball target devices are costly and relatively expensive.

DISCLOSURE OF INVENTION

The present invention relates to a golf ball target device that is characterized by its relative simplicity and low cost. In addition, the target device defines a target opening which is located at the putting surface, not elevated above it. The golf ball target device is compact and readily portable.

The golf ball target device of the present invention is of unitary construction and includes a hub portion for positioning on a support surface.

The target device includes at least one pair of arms, the arms of the at least one pair of arms being attached to the hub portion at spaced locations on the hub portion, projecting outwardly away from the hub portion and positionable over the support surface.

The arms of the at least one pair of arms have spaced distal ends. The hub portion has an arcuate golf ball engagement surface defining a recess located between the arms of the at least one pair of arms.

The arms of the at least one pair of arms each have a curved arm surface forming a continuation of and extending from the arcuate golf ball engagement surface to form an open ended target pocket including the recess for receiving a golf ball rolling on the support surface.

At least one protrusion projects into the target pocket at a location spaced from the open end of the target pocket for engagement by a golf ball moving in the target pocket. The at least one protrusion is for impeding movement of the golf ball and decreasing the likelihood of the golf ball exiting the target pocket through the open end thereof.

Other features, advantages, and objects of the present invention will become apparent with reference to the following description and accompanying drawings.

BEST MODE FOR CARRYING OUT THE INVENTION

Figure 1:
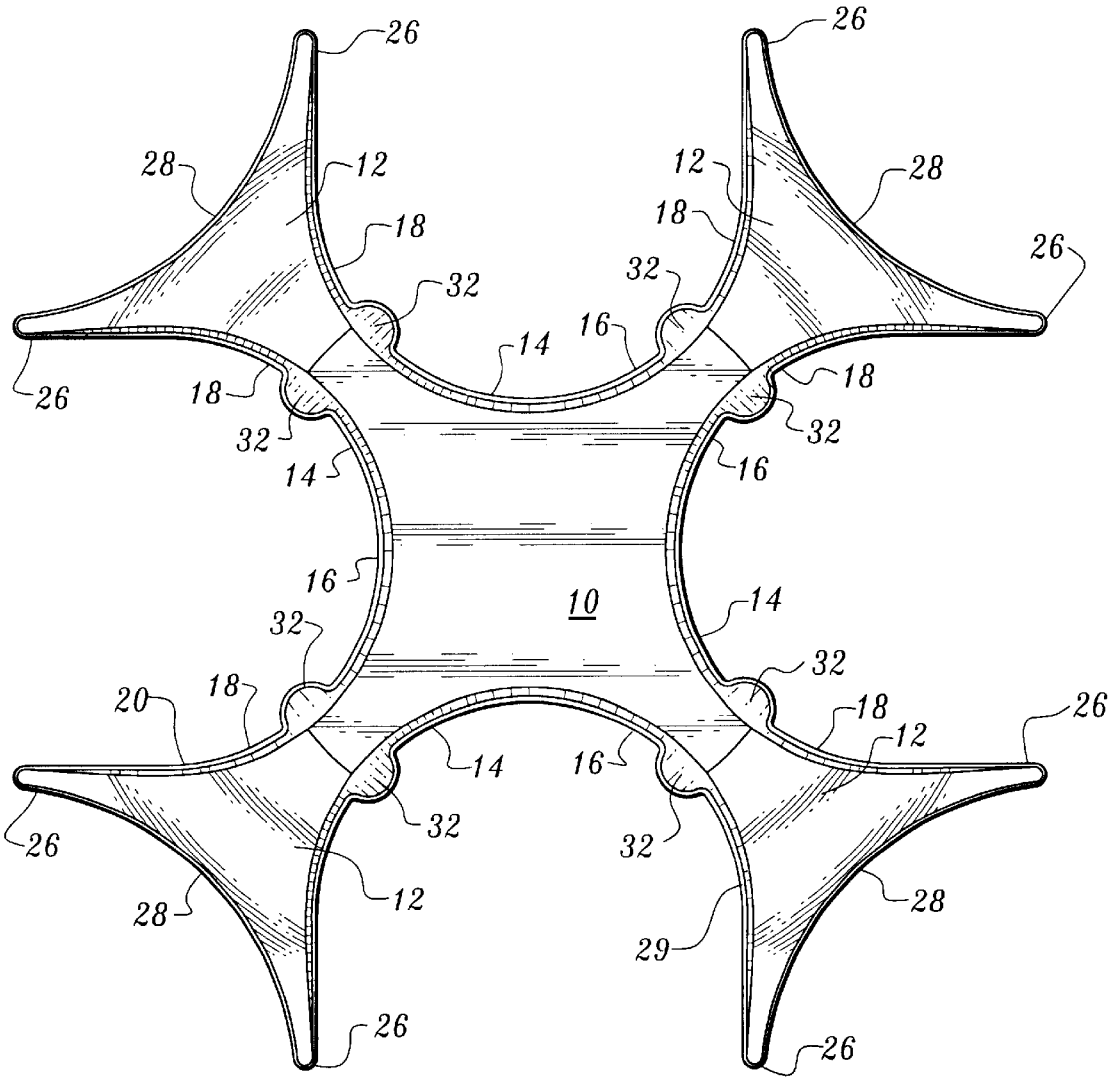
FIG. 1 is a top plan view of a golf ball target device constructed in accordance with the teachings of the present invention.
Figure 2:
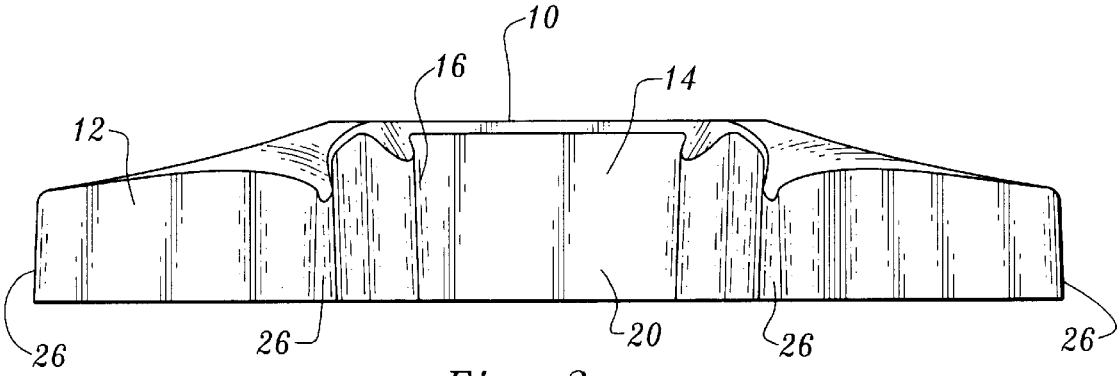
FIG. 2 is a front, elevation view of the golf ball target device.
Figure 3:
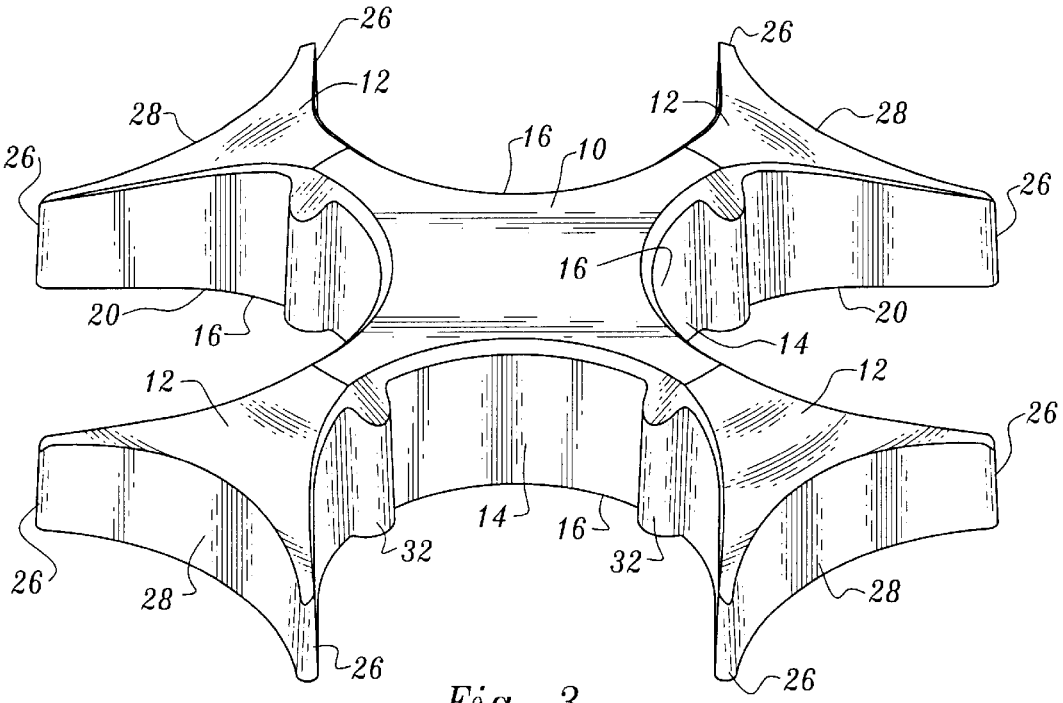
FIG. 3 is a front perspective view of the golf ball target device.
Figure 4:
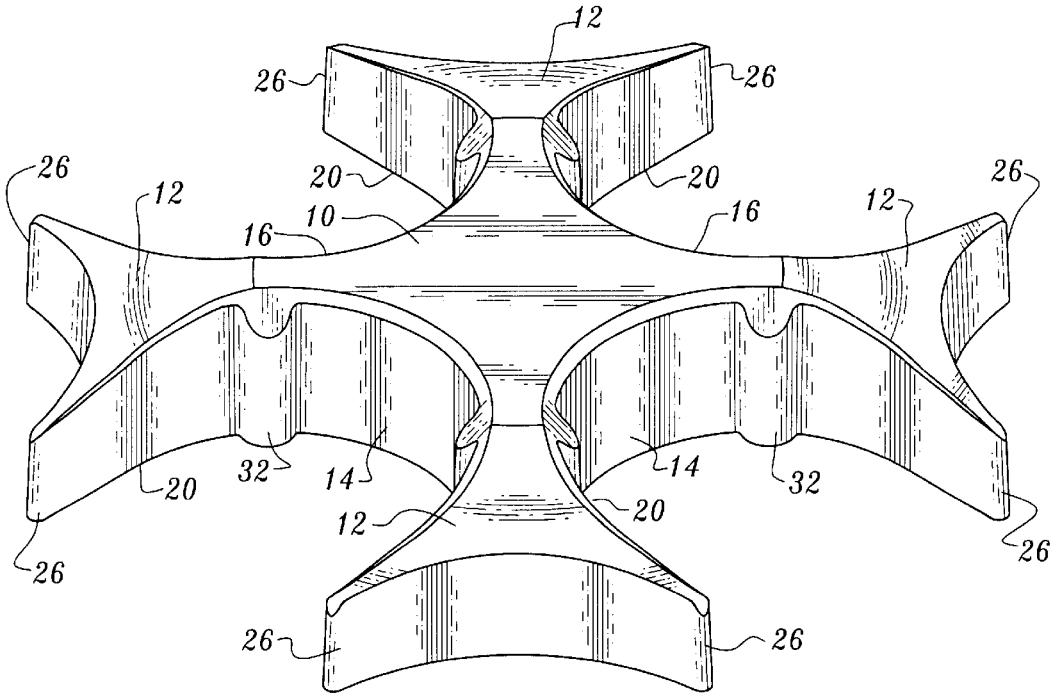
FIG. 4 is a view similar to FIG. 3, except that the target device is shown in a position rotated 45 degrees as compared to the position of FIG. 3.

Referring now to the drawings, a golf ball target device constructed in accordance with the teachings of the present invention includes a central or hub portion 10 for positioning on a support surface, such as a floor (not shown).

Four arms 12 of identical construction are integrally attached to hub portion 10. The arms are spaced from one another and adjacent arms 12 of the four spaced arms are disposed orthogonally with respect to one another. The shapes of the arms are identical.

The arms are attached to the hub portion at ninety degree increments, project outwardly away from the hub portion and are positioned over and on the floor or other support surface.

The hub portion 10 has four arcuate golf ball engagement surfaces 14 defining four equi-spaced recesses 16. Each recess 16 is located between the arms 12 of a pair of arms.

Each arm has a curved arm surface 18 forming a continuation of and extending from the arcuate golf ball engagement surface 14 to form an open ended target pocket 20, which includes the recess, for receiving a golf ball rolling on the support surface.

The distal end of each arm 12 includes two spaced projections 26 and an inwardly curved end wall 28 disposed between the spaced projections. Each arm 12 becomes wider as it progresses outwardly and is at its widest at the location of inwardly curved end wall 28. The projections 26 each are parallel to an adjacent projection of an adjacent arm whereby the open ended entrance to each target pocket is essentially defined by two straight parallel arm wall segments.

Two protrusions 32 project into each target pocket at locations spaced from the open end thereof. These protrusions are for engagement by a golf ball moving in the target pocket on the support surface and impede movement of the golf ball, decreasing the likelihood of the golf ball following the curvature of the target pocket and exiting the target pocket through the open end thereof.

The golf ball target device is preferably integrally formed of molded plastic material having a uniform predetermined durometer hardness. The projections 26 are resilient and flexible and will flex if hit by a golf ball to exert a spring-like action on the golf ball,"flicking" the golf ball away from the target device in the event of a miss. Similarly, a golf ball hitting one of the curved end walls 28 will follow the curve thereof and be redirected away from the device. On the other hand, as stated above, when the golf ball is on target and enters a target pocket 20, the protrusions 32 will prevent the ball from looping around the periphery of the target pocket, making it less likely that the ball will exit the pocket.

A suitable plastic material for forming the golf ball target device is Urethane Casting Resin and a suitable durometer hardness is, for example, within the range of from about 40 Shore Hardness to about 60 Shore Hardness. It will be appreciated that the device may be made in different durometer hardnesses depending upon the type and nature of the action one desires when putting a golf ball.

The device may simply be utilized as a target for golf ball putting practice; however, it is also possible to utilize the device when playing a game. For example, a number of players may compete to see who can successfully put the most balls into a target pocket. If desired, one target pocket may be assigned to one particular player. Different color golf balls may be assigned to the various players.

The invention claimed is:

1. A golf ball target device of unitary construction, said golf ball target device comprising, in combination:

a hub portion for positioning on a support surface; and at least one pair of arms, said arms of said at least one pair of arms being attached to said hub portion at spaced locations on said hub portion, projecting outwardly away from said hub portion and positionable over said support surface, said arms of said at least one pair of arms having spaced distal ends, said hub portion having an arcuate golf ball engagement surface defining a recess located between the arms of said at least one pair of arms, and the arms of said at least one pair of arms each having a curved arm surface forming a continuation of and extending from the arcuate golf ball engagement surface to form an open ended target pocket including said recess for receiving a golf ball rolling on the support surface, the distal end of each arm of said at least one pair of arms including two spaced projections and an inwardly curved end wall disposed between said spaced projections.

2. The golf ball target device according to claim 1 wherein said two spaced projections are resilient and flexible.

3. The golf ball target device according to claim 2 wherein said two spaced projections are tapered and have two converging projection side walls, at least one of said side walls forming a continuation of and extending from a curved arm surface.

4. The golf ball target device according to claim 1 including four spaced arms, adjacent arms of said four spaced arms being disposed orthogonally with respect to one another and said four spaced arms cooperable with said hub portion to define four spaced, open-ended target pockets.

5. The golf ball target device according to claim 4 wherein adjacent target pockets of said four spaced open-ended target pockets are equally spaced about said hub portion.

6. The golf ball target device according to claim 5 wherein at least one protrusion projects into each of said target pockets.

7. The golf ball target device according to claim 1 wherein each of said projections is substantially parallel to a projection of an adjacent arm.

8. The golf ball target device according to claim 1 wherein each arm has an increased width at the location of said inwardly curved end wall.

* * * * *